US009174080B2

(12) United States Patent
Harker

(10) Patent No.: US 9,174,080 B2
(45) Date of Patent: Nov. 3, 2015

(54) MODULAR EXERCISE POLE AND ANCHORING SYSTEM

(75) Inventor: Shon L. Harker, Syracuse, UT (US)

(73) Assignee: Hark'n Technologies, Inc., Clearfield, UT (US)

( * ) Notice: Subject to any disclaimer, the term of this patent is extended or adjusted under 35 U.S.C. 154(b) by 600 days.

(21) Appl. No.: 13/082,375

(22) Filed: Apr. 7, 2011

(65) Prior Publication Data

US 2011/0251025 A1 Oct. 13, 2011

Related U.S. Application Data

(60) Provisional application No. 61/321,853, filed on Apr. 7, 2010.

(51) Int. Cl.

| | |
|---|---|
| ***A63B 21/16*** | (2006.01) |
| ***A63B 21/04*** | (2006.01) |
| ***A63B 21/055*** | (2006.01) |
| ***A63B 71/02*** | (2006.01) |

(52) U.S. Cl.

CPC ..... *A63B 21/16* (2013.01); *A63B 21/0442* (2013.01); *A63B 21/0552* (2013.01); *A63B 71/023* (2013.01); *A63B 2071/026* (2013.01); *A63B 2210/50* (2013.01); *A63B 2225/68* (2013.01)

(58) Field of Classification Search

USPC ..... 482/1–148

See application file for complete search history.

(56) References Cited

U.S. PATENT DOCUMENTS

| | | | | |
|---|---|---|---|---|
| 1,703,012 | A * | 2/1929 | McNamara | 482/90 |
| 4,486,016 | A * | 12/1984 | Rubin | 482/90 |
| 5,792,032 | A * | 8/1998 | Williams et al. | 482/83 |
| 5,863,278 | A * | 1/1999 | Chen | 482/83 |
| 5,899,835 | A * | 5/1999 | Puranda | 482/90 |
| 6,080,089 | A * | 6/2000 | Nicholson | 482/83 |
| 6,328,665 | B1 * | 12/2001 | Gormley | 473/423 |
| 7,086,997 | B1 * | 8/2006 | Fields et al. | 482/90 |
| 7,704,194 | B1 * | 4/2010 | Chen | 482/87 |
| 7,798,920 | B1 * | 9/2010 | Cortes | 473/440 |
| 8,360,938 | B2 * | 1/2013 | Gilman | 482/51 |
| 8,371,995 | B2 * | 2/2013 | Crawford | 482/83 |
| 8,641,583 | B2 * | 2/2014 | Chen | 482/83 |

* cited by examiner

*Primary Examiner* — Stephen Crow

(74) *Attorney, Agent, or Firm* — Legends Law Group, PLLC; Stephen H. Bean, Esq.

(57) ABSTRACT

A modular exercise pole and anchoring system is provided. The present invention relates to an exercise pole with multiple vertical and horizontal attachment points for connecting resistance training devices, the pole being attached to a base having a base post that accepts a plurality of plate-type weights for anchoring. The exercise pole and anchoring system have application to resistance training for fitness, among other uses, while the anchoring system alone has application to a number of uses where convenient, removable anchoring is desired.

16 Claims, 7 Drawing Sheets

MODULAR EXERCISE POLE AND ANCHORING SYSTEM

FIELD OF THE INVENTION

The present invention relates to a modular exercise pole and anchoring system. More particularly, the present invention relates to an exercise pole with multiple vertical and horizontal attachment points for connecting resistance training devices, the pole being attached to a base having a base post that accepts a plurality of plate-type weights for anchoring. The exercise pole and anchoring system have application to resistance training for fitness, among other uses, while the anchoring system alone has application to a number of uses where convenient, removable anchoring is desired.

BACKGROUND OF THE INVENTION

Current exercise poles require either permanent attachment to walls, ceilings, and floors or require bottom plate suction means that can mar a floor. In addition, floor anchored exercise poles also require the user to fill a hollow container with sand or water in order to provide adequate anchoring weight for the device. The drawbacks to the prior art methods of placing exercise poles include the unsightly and permanent destruction of walls, ceilings, and floors. Prior art devices also do not provide for simple removal of the anchoring weight, such as water or sand, when the exercise unit is to be relocated.

SUMMARY OF THE INVENTION

The present invention provides a novel exercise pole and anchoring system that is easily built, placed, and anchored. The anchoring device of the present invention allows a user to quickly add or remove plate-type weights commonly found in gyms to provide sufficient anchor weighting to the exercise unit.

BRIEF DESCRIPTION THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single FIGURE, and as such, multiple figures are presented to separately illustrate the various details of the invention in greater clarity.

DETAILED DESCRIPTION OF THE INVENTION

Figure 1:
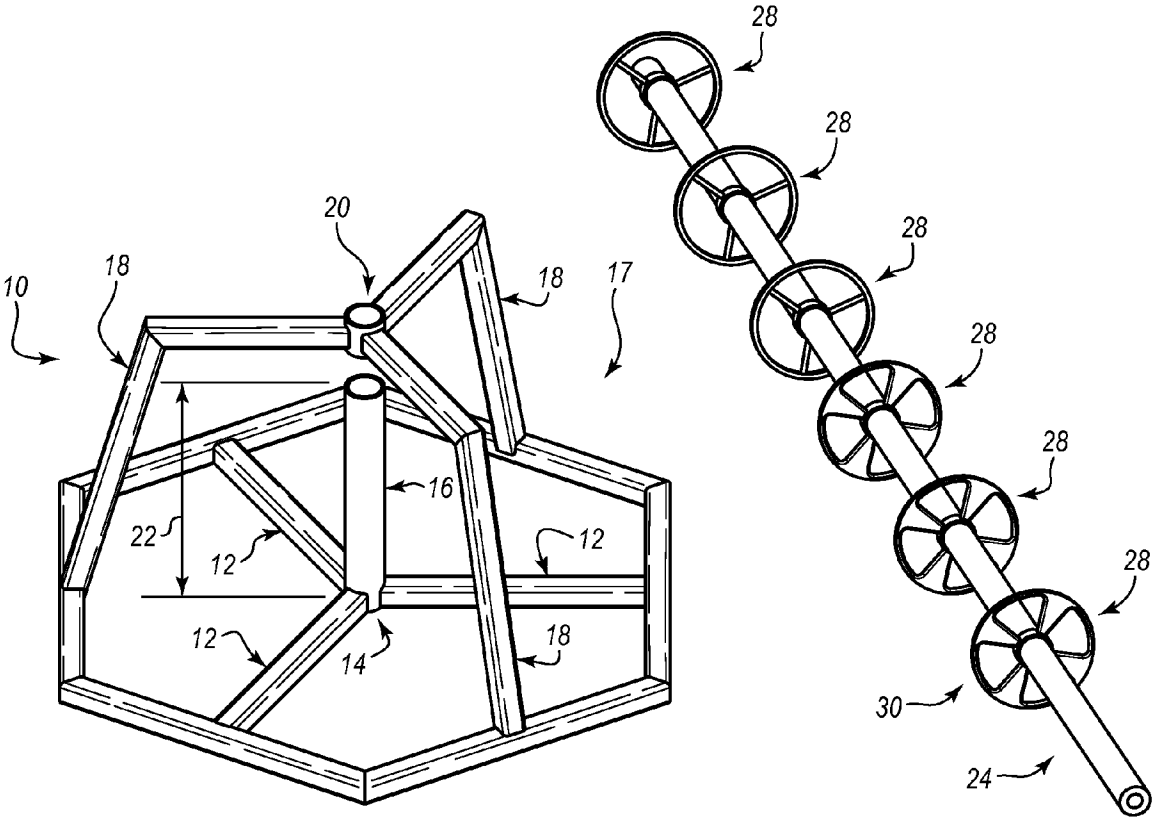
FIG. 1 shows a top angle view of the modular exercise pole and anchoring system of the present invention.

The present invention relates to a novel modular exercise pole and anchoring system. In one embodiment of the invention (referring to FIG. 1), there is a base (10) which forms an anchor to hold exercise pole (24) in place. Base (10) can be formed from any solid material that will provide rigidity and strength. Preferably, base (10) is made of square tubular steel measuring 1.5 inches square, but it can also be formed from angle iron. It is desired that base (10) have a width or diameter of at least 36 inches in order to accommodate most large plate weights found in a typical gym or exercise facility. In one embodiment of the invention, base (10) is formed in the shape of a hexagon, while another embodiment contemplates a circular shape.

Base spokes (12) radiate inward and meet at spoke junction (14), located in the center of the region bounded by base (10). If base (10) is in the form of a hexagon, then three base spokes (12) are preferably used. Base post (16) is formed rising up from spoke junction (14) and is preferably made from circular tubular steel. Side arms (18) are connected to base (10) and are formed to rise vertically above base (10) and to meet at side arm junction (20), located in the center of the region above the space bounded by base (10). Together, base (10), base spokes (12), and side arms (18) form a protective cage (17) wherein plate weights (5) can be placed. A height h (22) is measured between spoke junction (14) and side arm junction (20). Base post (16) should be a length less than height h (22) such that plate weights (5) can be inserted between side arms (18) at the top of protective cage (17) and stacked over base post (16). Side arms (18) serve not only to provide a rigid frame for exercise pole (24), but also function to protect the user from inadvertently kicking or otherwise contacting plate weights (5) that anchor the exercise unit.

Base (10), base spokes (12), base post (16) and side arms (18) can be connected in any number of different ways, including welding and through mechanical connections such as bolts, screws, and clamps. Side arm junction (20) is formed as a tubular sleeve connected to side arms (18). The internal diameter of side arm junction (20) should be the same as the internal diameter of base post (16) such that exercise pole 24 can be inserted downward through side arm junction (20) and into base post (16) and securely held in place through either friction or through set screws tapped into base post (16) and/or side arm junction (20).

In another embodiment of the present invention, exercise pole (24) is configured such that it can be connected to base (10) without the need for base post (16). In this case, plate weights (5) are placed within protective cage (17) and are stacked over base spokes (12) in a manner that allows the exercise pole (24) to be inserted downward from side arm junction (20), through the holes in plate weights (5) and positioned for connection with spoke junction (14).

In yet another embodiment, side arms (18) can be configured to support a flat surface forming the top portion of protective cage (17). In this manner, the modular exercise pole and anchor system of the present invention can be configured with a stepping platform that would allow the user to implement even more exercise routines. Spaces for storing resistance training devices (5) and other exercise equipment such as exercise gloves, gripping powders, and the like could also be configured within protective cage (17).

For cosmetic purposes, side arms (28) can be covered with a plastic or cloth material. However, any such cosmetic covering should be easily detachable in order to facilitate convenient removal of plate weights (5) from the base post (16).

Figure 8:
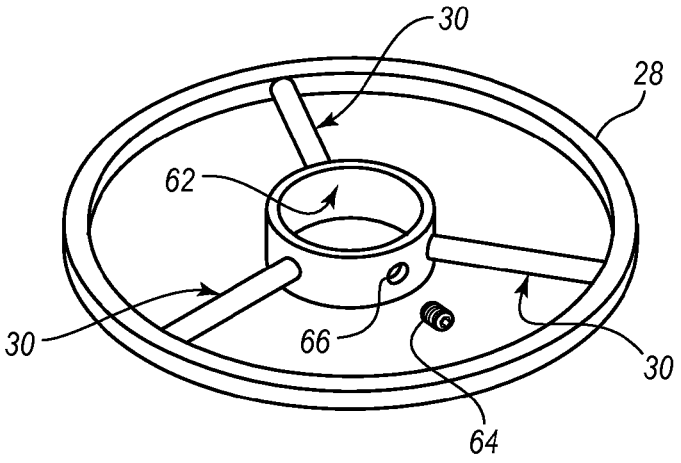
FIG. 8 shows a top angle view of an attachment ring with a ring hub configured for attachment to the exercise pole via a set screw.

Exercise pole (24) can be any length sufficient to offer a wide range of attachment points for accommodating exercise devices such as resistance training devices (2). One common type of resistance training device is the SLASTIX® brand sheathed elastics, which are well-known for their ease of use, versatile tensile strengths, rugged construction, and safety features. Exercise pole (24) supports attachment rings (28), which are configured at various intervals across the pole. Attachment rings (28) have ring spokes (30) that prevent the attached training devices (2) from sliding in an endless circular motion. By providing ring spokes (30), the invention allows multiple users to exercise on the same pole without compromising safety or convenience. In addition, ring spokes (30) allow a single user to perform more complicated exercises using multiple resistance devices (2). Ring spokes (30) can be welded directly to exercise pole (24). However, a preferred method is to form annular ring hub (62) within the space bounded by annular attachment ring (28) (referring to FIGS. 8 and 9). Ring spokes (30) are connected between the outer attachment ring (28) and the inner ring hub (62). If ring hub (62) is used, a convenient method for affixing attachment ring (28) to exercise pole (24) is to use receiving hole (66) and set screw (64). In this manner, the location of attachment rings (28) along the length of exercise pole (24) can be easily adjusted to provide a customized workout experience.

Figure 2:
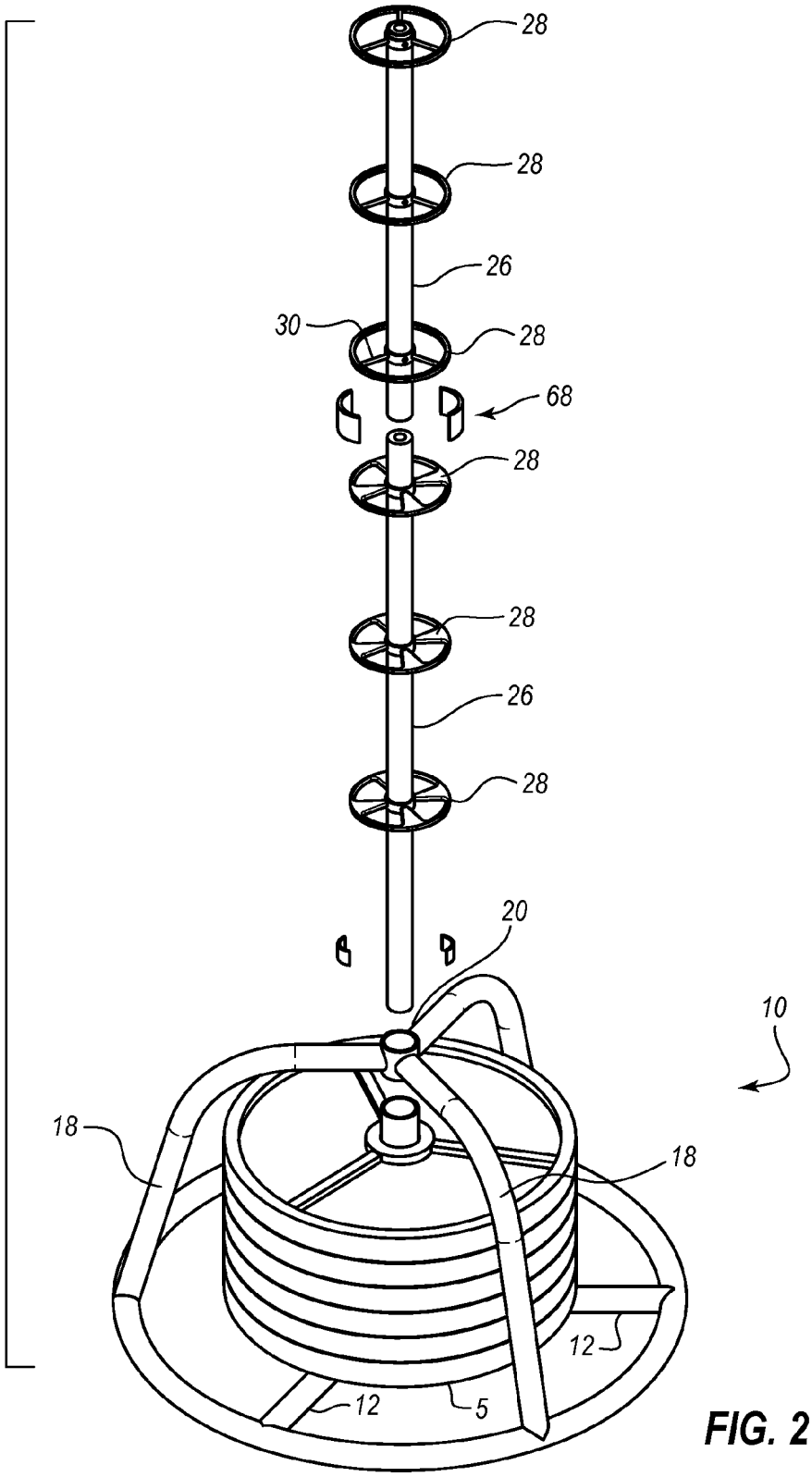
FIG. 2 shows a partially exploded top angle view of the modular exercise pole and anchoring system of the present invention, where the pole is comprised of two pole segments shown in exploded view.
Figure 9:
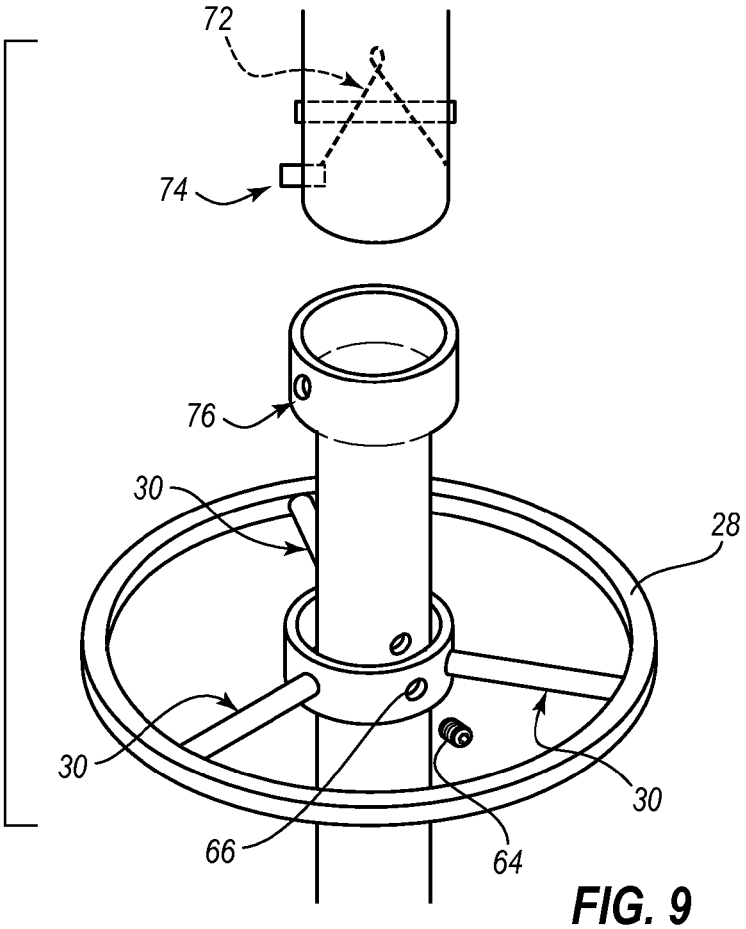
FIG. 9 shows a side angle view of the exercise pole segments connected via a spring bar connection.
Figure 10:
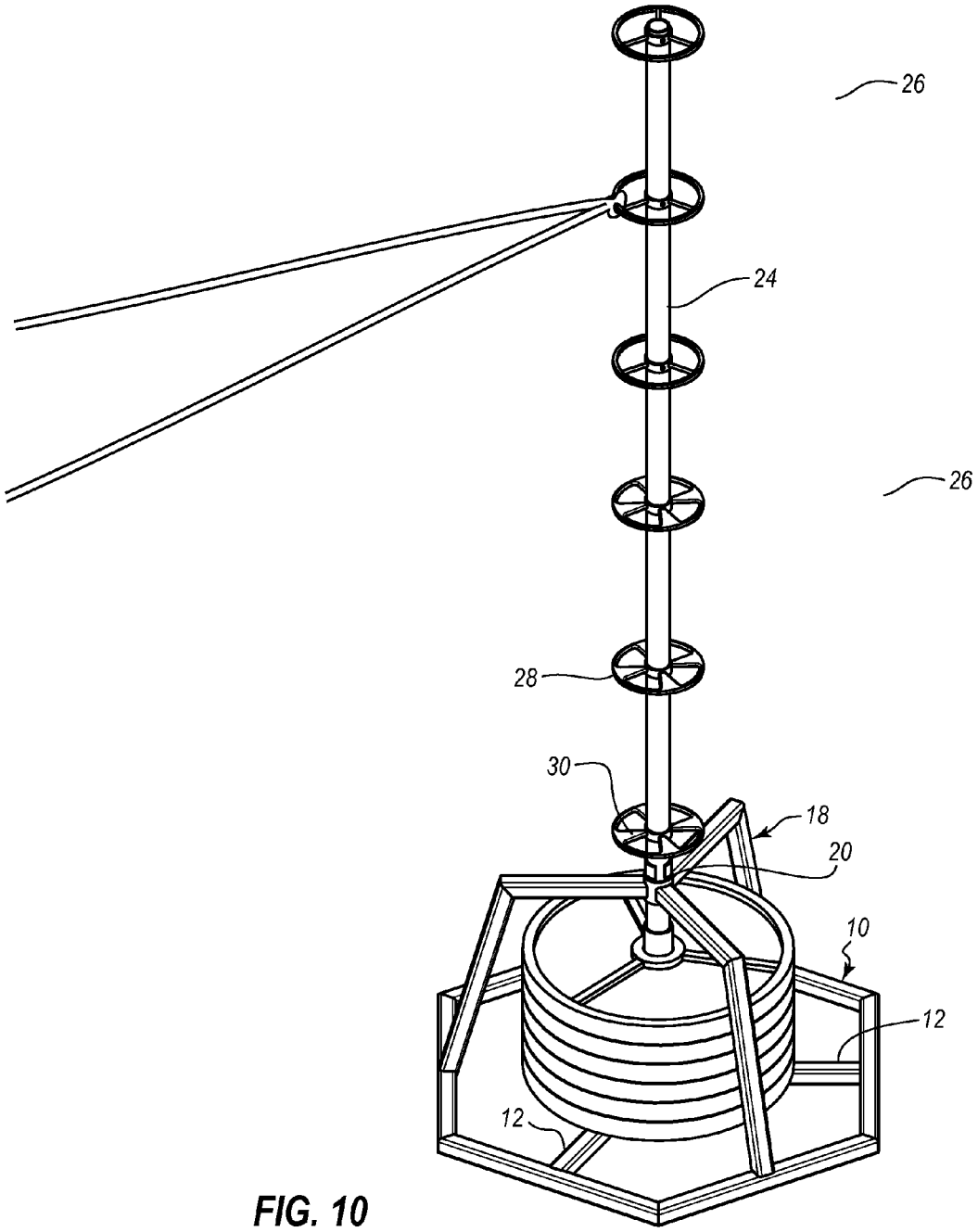
FIG. 10 shows a side angle view of one embodiment of the modular exercise pole and anchoring system of the present invention.

In one embodiment of the invention, exercise pole (24) is formed from multiple pole segments (26) (referring to FIGS. 2 and 9). When pole segments (26) are used, it is important that the connection between segments is strong. Pole segments (26) can have matching male and female ends for secure end-to-end connection to each other. Those of ordinary skill in the industry will appreciate the various connection methods available for ensuring a strong, solid attachment between pole segments (26). In one embodiment, pole segments (26) are configured for mating through inset threads and screw-type action. Another connection method involves using clamps (68) across the connection joint. While yet another embodiment contemplates a spring bar (74) and spring pin (72) arrangement (shown in FIG. 9). Combinations of these connection techniques can also be employed. In this manner the exercise pole can be constructed of varying pole segments depending on the most cost-effective packing and shipping methods.

Figure 7:
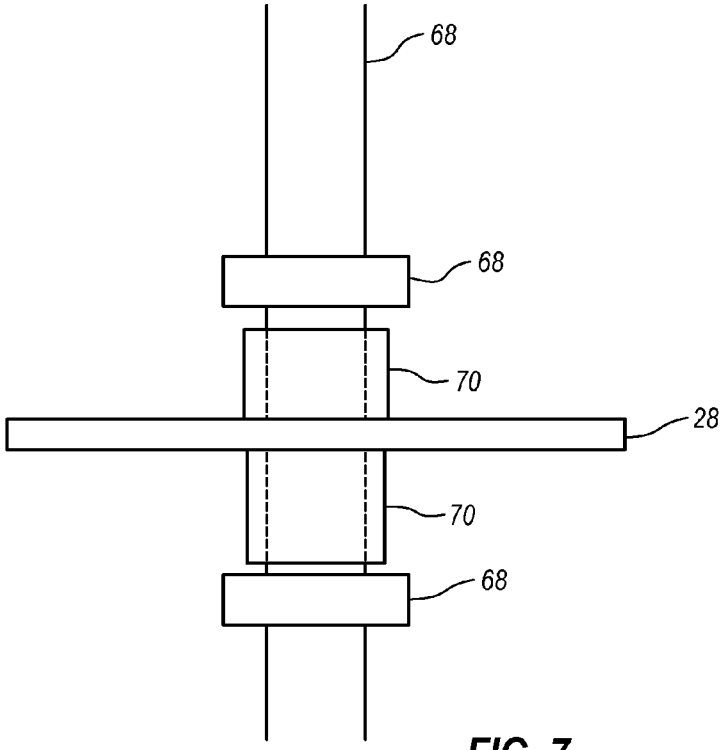
FIG. 7 shows a side view of the attachment rings configured with sleeve bushings for rotational use on the modular exercise pole and anchoring system of the present invention.

Another novel feature of the present invention is the ability to selectively rotate certain attachment rings (28) through the use of sleeve bushings (70) (referring to FIG. 7). In this embodiment, clamps (68) are located along the length of exercise pole (24) and are used to prevent sleeve bushings (70) from moving beyond a determined longitudinal position along the pole. Sleeve bushings (70) are sized with an inner diameter just larger than the outer diameter of pole (24) such that the bushings can freely rotate around the pole. Attachment ring (28) is then affixed to sleeve bushing (70). In this manner, exercise pole (24) can be selectively configured with rotating attachment rings (28). The combination of rotating and non-rotating attachment rings (28) along pole (24) is a novel feature of the present invention that yields an extremely wide variety of possible exercise routines using resistance training devices (2).

Figure 3A:
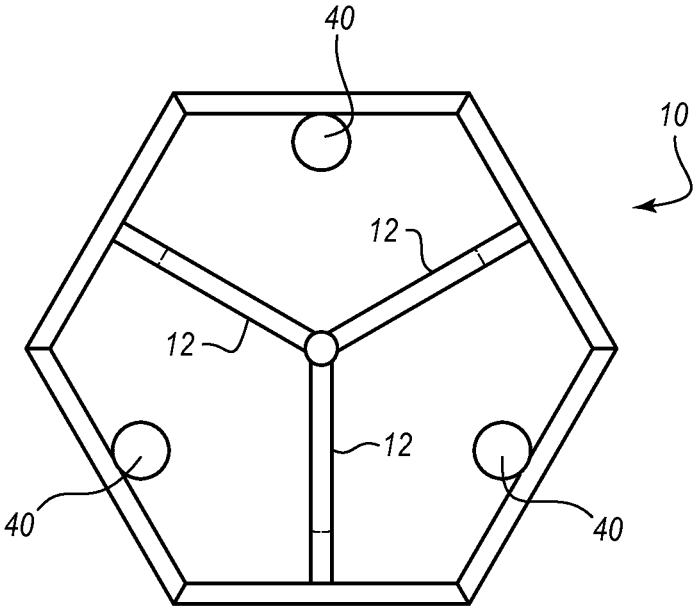
FIG. 3A and FIG. 3B show top perspective views of both the hexagonal and rounded configuration of the anchor base and spokes with different wheel configurations.
Figure 3B:
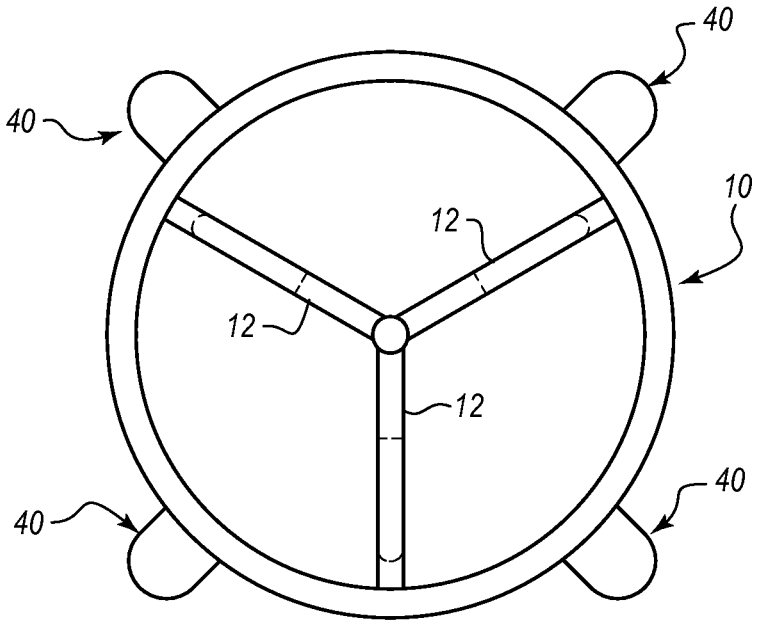
Figure 4:
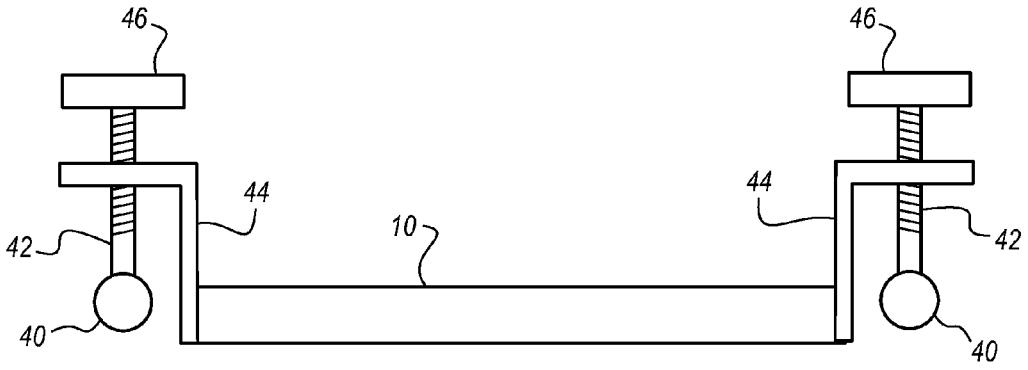
FIG. 4 shows a side perspective view of one embodiment of the wheels attached through wheel brackets to the anchor base and configured for use with the present invention.

In yet another embodiment of the present invention, base (10) is provided with wheels (40) that can be selectively moved from a resting to a working position. Referring to FIG. 3, wheels (40) can be located either inside or outside of base (10). If located outside base (10), wheels (40) can be configured in a square arrangement to make a more easily packaged and shipped product. Referring to FIG. 4, wheel post bracket (44) is attached to base (10) through welding, clamps, bolts, or some other method of secure connection. Wheel post (42) can be a threaded rod adapted for adjustable vertical movement through wheel bracket (44). Wheel post (42) is connected on one end to wheel post handle (46) and the other end to wheel (40). By twisting wheel post handle (46), wheel (40) can be selectively raised or lower depending on need. To move the entire assembly, the user would simply twist each wheel post handle (46) until base (10) is raised off the floor and the unit is resting on its wheels. The unit can be easily lowered through the reverse procedure.

Figure 5:
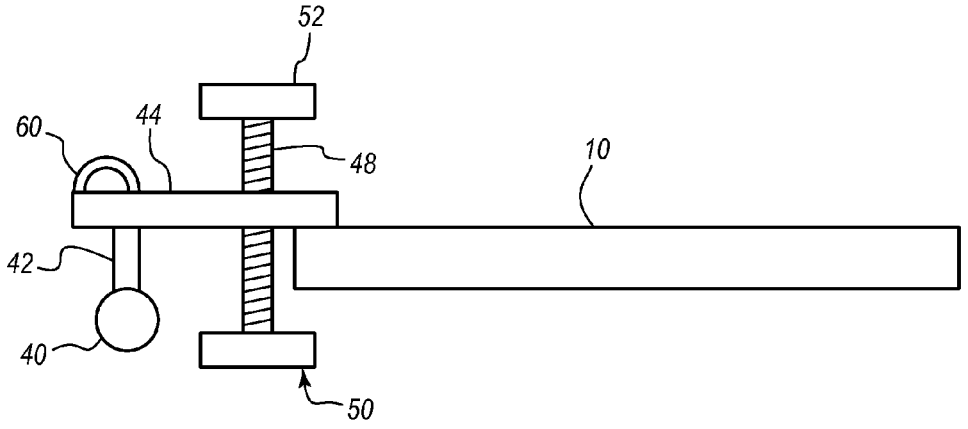
FIG. 5 shows a side perspective view of one embodiment of foot posts configured for use with the present invention.

Another wheel configuration contemplated in the present invention is shown in FIG. 5. In this embodiment, wheel post bracket (44) is securely connected to base (10) as before. Wheel post (42) is connected on one end to wheel (40) and on the other end to wheel post bracket (44) but it is not configured for selective movement. Instead, foot post (48), which is a threaded rod, is threaded through a hole in wheel post bracket (44) and connected on one end to foot post handle (52) and on the other end to foot pad (50). By twisting foot post handle (52), the user can position the unit in a desired location by raising the unit up so that wheels (40) do not touch the floor. A reverse motion on foot post handle (52) will raise foot pad (50) up off the floor until the unit is resting on wheels (40).

Figure 6:
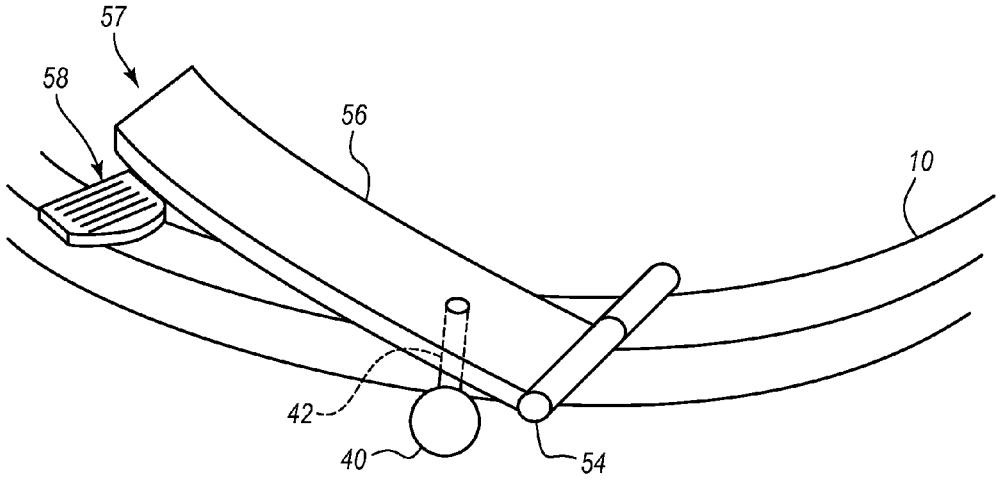
FIG. 6 shows a top angle view of a wheel and step lifter configuration used with the present invention.

Yet another wheel configuration is shown in FIG. 6. Here, hinge (54) is securely connected to base (10) and step lifter (56). Wheel post (42) connects on one end to the underside of step lifter (56) and on the other end to wheel (40). Wheel post (42) is spaced a sufficient distance away from hinge (42) such that a fulcrum point is created between hinge (54) and a distal end (57) of step lifter (56). Latch (58) is attached to base (10) such that it can selectively receive distal end (57) of step lifter (56). By stepping on distal end (57) of step lifter (56), the user can lift base (10) off the floor and cause the unit to rest on wheel (40). Distal end (57) of step lifter (56) can be latched to base (10) using latch (58) to lock wheels (40) in a useable position for moving the unit. The above-described wheel arrangements can be configured on either the inside or the outside of base (10), depending on the user's preference. In addition, ring (60) (referring to FIG. 5) can be attached to wheel post bracket (44) to create a low attachment point for lifting the unit with straps or for attaching resistance training devices (2) to still further expand the user's exercise possibilities.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. An exercise device comprising:

an anchor having a lower base portion, a post configured for securely receiving weighted objects, and side arms, said base and side arms defining a protective cage around said post;

a pole configured to be received within said protective cage of said anchor;

attachment points along said pole, said attachment points being configured to selectively receive exercise apparatuses; wherein said side arms comprise side portions and top portions that extend over said lower base portion and terminate into a side arm junction, said side arm junction configured for receiving said pole and wherein a gap for receiving weighted objects is defined between said side arm junction and said post.

2. The exercise device of claim 1, further comprising storage spaces located within said protective cage.

3. The exercise device of claim 1, further comprising a horizontal exercise surface above said top portions of said side arms.

4. The exercise device of claim 1, further comprising an attachment ring located on said lower base portion of said anchor.

5. The exercise device of claim 1, wherein said pole comprises multiple pole segments configured for secure connection into a single functioning pole unit.

6. The exercise device of claim 1, wherein said attachment points comprise annular rings configured at various intervals along said pole.

7. The exercise device of claim 6, wherein said rings are configured for adjustable movement along said pole.

8. The exercise device of claim 6, further comprising a sleeve bushing located along a portion of said pole, wherein said sleeve bushing is restrained in vertical movement by upper and lower clamps and wherein said sleeve bushing is operably connected to an annular ring such that said sleeve bushing can rotate around said pole.

9. The exercise device of claim 8, further comprising:

a wheel post bracket affixed to said anchor, said bracket having a threaded receiving hole;

a threaded rod configured for insertion into said receiving hole of said wheel post bracket; and a wheel affixed to said threaded rod.

10. An exercise system comprising:

an anchor having a base portion and side arms, wherein said side arms comprise side portions and top portions that extend over said base portion and terminate into a side arm junction, wherein said base portion and said side arms define a protective cage for holding weighted objects;

a pole configured for insertion into said junction and adapted to be securely held in place by said weighted objects;

attachment points located along said pole, said attachment points being configured to selectively receive exercise apparatuses said side arm junction configured for receiving said pole and wherein a gap for receiving weighted objects is defined between said side arm junction and said post.

11. The exercise system of claim 10, wherein said pole comprises multiple pole segments configured for secure connection into a single functioning pole unit.

12. The exercise system of claim 10, wherein said attachment points comprise annular rings configured at various intervals along said pole.

13. The exercise system of claim 12, wherein said rings are configured for adjustable movement along said pole.

14. The exercise system of claim 12, further comprising a sleeve bushing located along a portion of said pole, wherein said sleeve bushing is restrained in vertical movement by upper and lower clamps and wherein said sleeve bushing is operably connected to an annular ring such that said sleeve bushing can rotate around said pole.

15. The exercise system of claim 14, wherein said attachment points comprise a plurality of un-rotatable and rotatable attachment points.

16. The exercise system of claim 15, wherein said exercise apparatuses comprise elastic resistance training devices.

* * * * *